United States Patent [19]

Taylor et al.

[11] 4,141,276

[45] Feb. 27, 1979

[54] LOCKING AND FIRING MECHANISM FOR ROTATING-CAM ACTUATED WEAPONS

[75] Inventors: David C. Taylor, Milan; Gerald R. Anderson, Coal Valley, both of Ill.

[73] Assignee: The United States of America as represented by the Secretary of the Army, Washington, D.C.

[21] Appl. No.: 821,016

[22] Filed: Aug. 1, 1977

[51] Int. Cl.[2] ..... F41F 11/06

[52] U.S. Cl. ..... 89/11; 89/188

[58] Field of Search ..... 42/2, 15, 39.5; 89/9, 89/11, 17, 33 ML, 155, 188

[56] References Cited

U.S. PATENT DOCUMENTS

| | | | |
|---|---|---|---|
| 1,344,911 | 6/1920 | Lewis | 89/188 |
| 3,766,821 | 10/1973 | Cozzy et al. | 89/188 |
| 4,065,998 | 1/1978 | Rocha | 89/11 |

*Primary Examiner*—Stephen C. Bentley

*Attorney, Agent, or Firm*—Nathan Edelberg; Robert O. Richardson

[57] ABSTRACT

In a rotary-cam operated weapon a locking and firing structure that distributes the firing load symmetrically about the longitudinal axis of the weapon to eliminate nonsymmetrical stresses, and to coordinate the locking and firing timing relationships.

5 Claims, 5 Drawing Figures

LOCKING AND FIRING MECHANISM FOR ROTATING-CAM ACTUATED WEAPONS

GOVERNMENT RIGHTS

The invention described herein may be manufactured and/or used by or for the Government for governmental purposes without the payment of any royalty thereon.

BACKGROUND OF THE INVENTION

In firing large caliber weapons, a considerable impulse is generated by the detonated cartridge. This impulse is initially imparted to the breech, which is generally locked to the barrel. In this manner the mechanism which locks the breech to the barrel receives the firing load. Conventional locking mechanisms for this purpose include the lug type, which utilizes one or more locking lugs to retain the breech in the locked position. Sliding breech blocks, which simply slide across the chamber opening, are also used. It is important that the firing load be symmetrically transmitted to the weapon receiver. This is because unsymmetrical forces induce bending moments which can warp or break major weapon components.

In order to symmetrically distribute the firing load, the locking mechanism must engage the weapon receiver symmetrically about the longitudinal axis of the weapon bore. Neither of the aforementioned types of locking mechanisms easily lends itself to this concept.

It is also desirable to insure that locking is complete before the weapon is fired. Conventional locking mechanisms do not normally include means to preclude the possibility of firing a weapon when it is in an unlocked or partially locked condition. Completing locking before firing is desirable to prevent damage to the weapon or the weapon operator.

SUMMARY OF THE PRESENT INVENTION

A locking mechanism in accordance with the present invention overcomes the problems previously discussed by insuring locking is complete before firing can occur and by a symmetrical distribution of the firing load. The mechanism described is for use primarily with externally powered rotating cam actuated weapons.

The weapon utilizes a driven drum cam which rotates to cause longitudinal reciprocation of the chamber and operating group. The drum also carries a lump cam on its inside diameter. This lump cam contacts a pivoted actuator as the drum rotates. The lump cam and actuator have a cam/follower relationship which converts the unidirectional rotary motion of the drum to bidirectional oscillating motion of the actuator. The actuator is connected by means of gear teeth to a locking ring. The locking ring is a cog wheel which is attached to and moves with the chamber of the weapon. The locking ring rotates in response to the oscillating motion of the actuator to lock and unlock the weapon.

Located on the inside diameter of the lock ring is another small cam path. Riding in this cam path is a follower referred to as the sear extension. The opposite end of the sear extension contacts the main sear of the weapon. As the lock ring rotates toward the locked position the sear extension rides up the cam path. When the lock ring has rotated to the fully locked position just enough lift has occurred to release the sear and the weapon fires. If the lock ring does not turn to full lock, the sear extension cannot reach full lift. This feature prevents the weapon from being fired in any position other than the desired full lock position.

The lock ring is concentric about the longitudinal axis of the weapon. Therefore, symmetrical firing loads are transmitted to the receiver and no bending moments are induced.

Figure 1:
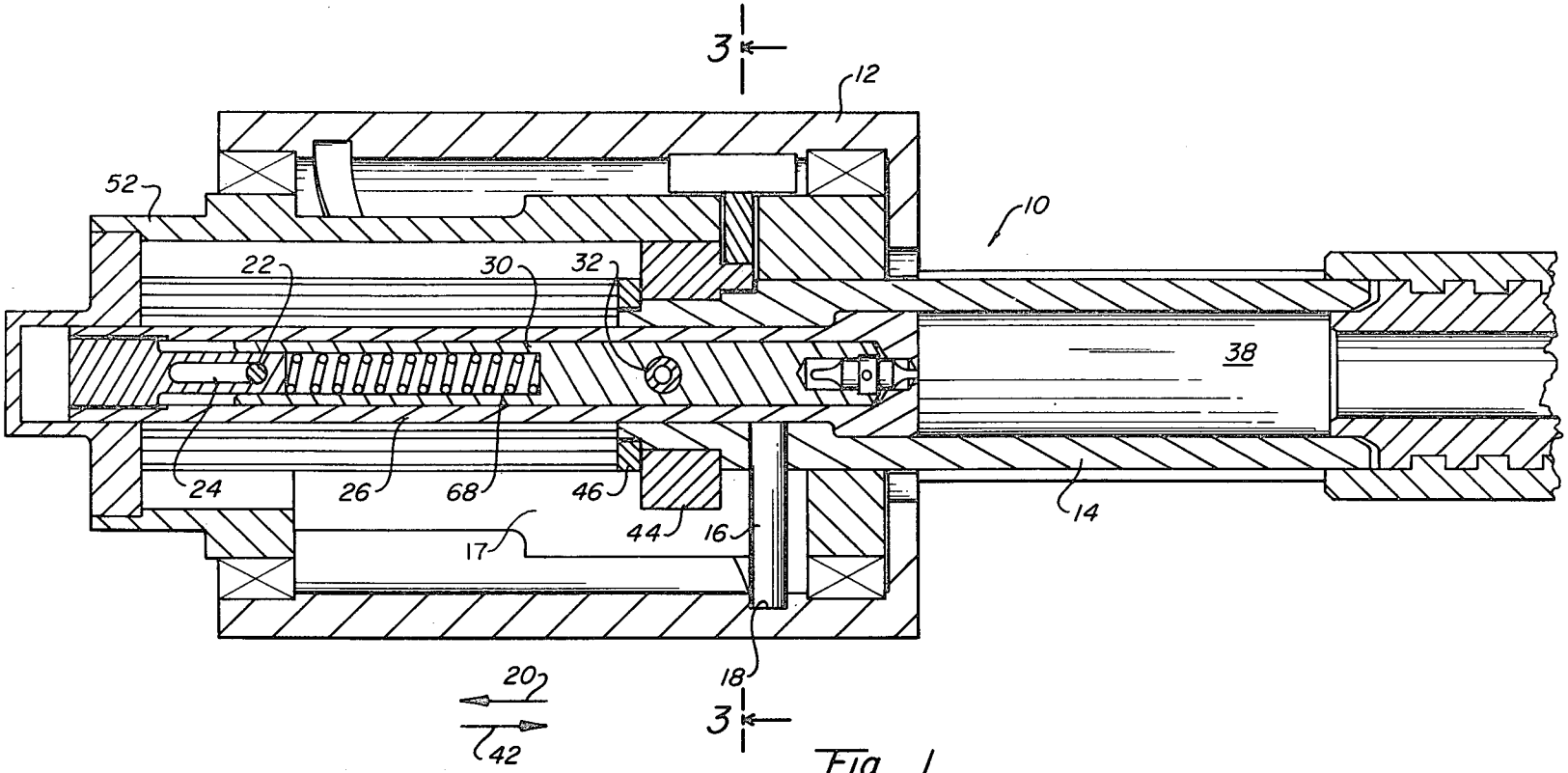
FIG. 1 is a longitudinal sectional view showing the chamber in in-battery position and illustrating the operation of the weapon as the chamber moves longitudinally between its recoil and in-battery positions.
Figure 2:
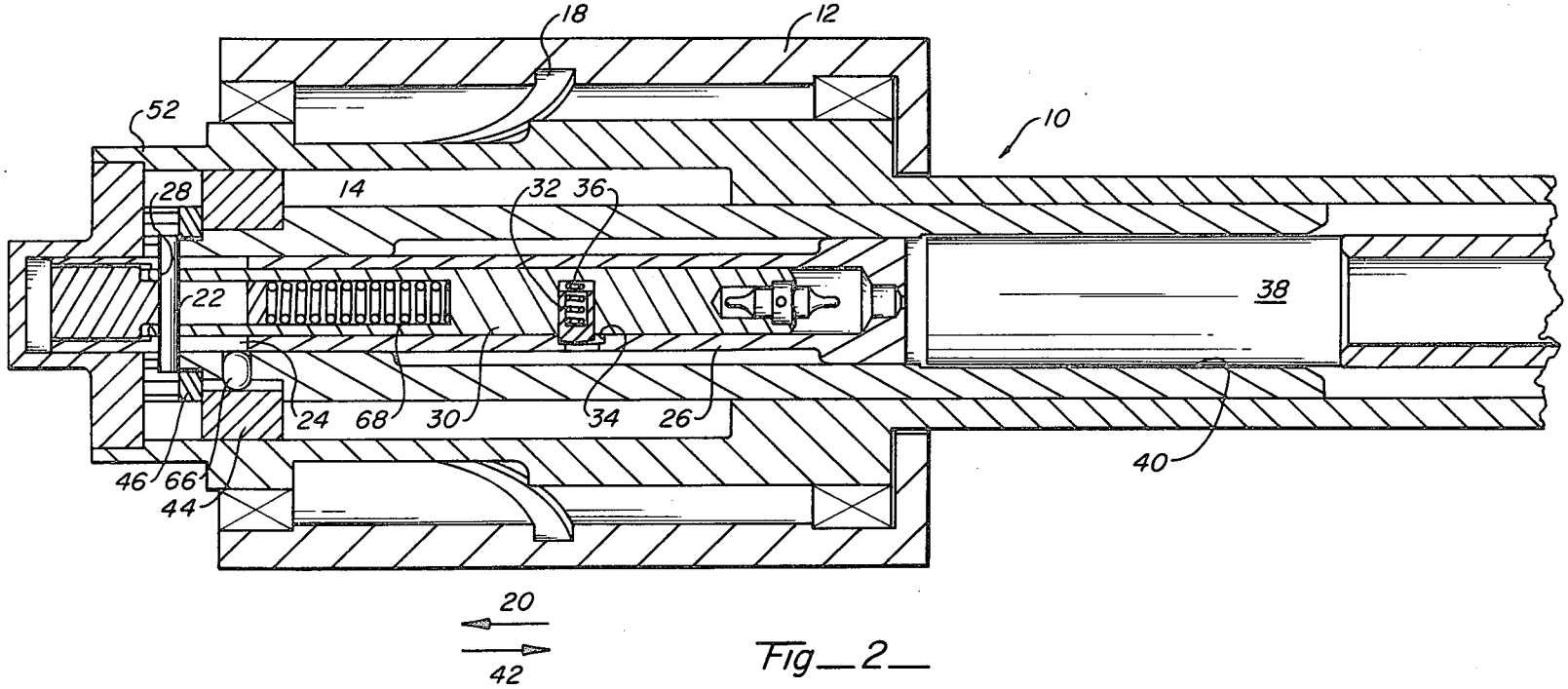
FIG. 2 is a longitudinal sectional view similar to FIG. 1, showing the operation of apparatus for firing the weapon when the chamber is in the full recoil position.

Reference is made to FIG. 1 wherein there is shown an externally powered weapon 10 having a locking and firing mechanism in accordance with the present invention. The weapon 10 is activated by an electric motor (not shown) which causes the drum cam 12 to rotate. Rotation of the drum cam 12 causes reciprocal motion of the chamber 14 by means of a stud 16 which extends through a slot 17 in the receiver 52 and engages a helical cam path 18 on the inside diameter of the drum cam 12. As the drum cam 12 rotates the chamber 14 is moved rearwardly, in the direction of arrow 20, toward its recoil position shown in FIG. 2. Near the end of its rearward travel, the rear end of chamber 14 engages a pin 22 which passes through an enlongated slot 24 in the bolt 26. The pin 22 also passes through an aperture 28 in the striker 30, as shown in FIG. 2. Further rearward movement of the chamber 14 causes rearward movement of the striker 30 relative to the bolt 26. As the chamber 14 and striker 30 continue rearward movement, the main sear 32 is aligned with a sear notch 34 in the bolt 26 as shown in FIG. 2. When the sear 32 is aligned with the notch 34, a helical spring 36 urges the sear 32 into engagement with the notch 34.

As the chamber 14 reaches the full recoil position, as shown in FIG. 2, the spent cartridge case is ejected while a fresh round 38 is introduced into the chamber area 40. Continued rotation of the drum cam 12 returns the chamber 14 toward the in-battery position in the direction of arrow 42. The round 38 is encapsulated by the chamber 14 as the in-battery position is reached. The striker 30 is retained in its rearmost position by engagement of the sear 32 with the sear notch 34 as previously described.

A lock ring 44 is movably attached to the rearmost end of the chamber 14. The lock ring 44 is secured by means of a retaining ring 46 which is threaded to the chamber and locked by a set screw (not shown). By this means the lock ring 44 is securely fastened to the chamber 14 while still allowing free rotation of the ring.

Figure 3:
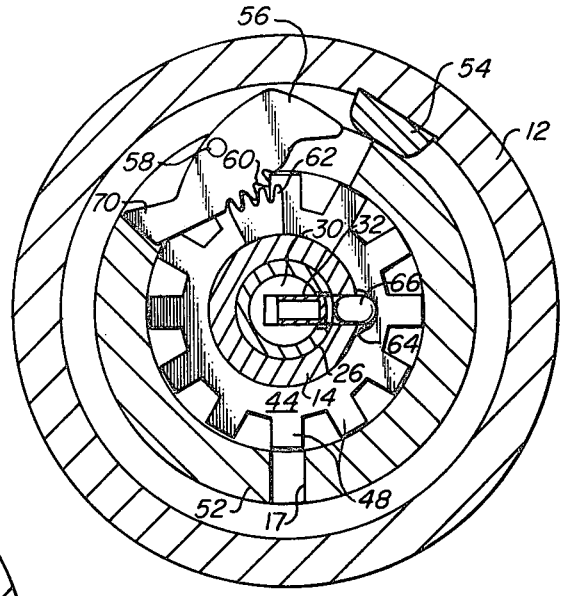
FIG. 3 is an end view taken along line 3—3 of FIG. 1 showing the locking structure for locking the chamber in the in-battery position.

Referring to FIG. 3 there is shown the locking and firing mechanism in the unlocked position. As can be seen the lock ring 44 has a plurality of teeth 48 about its outer diameter. These teeth are symmetrically spaced about the ring axis of rotation. In the unlocked position, the teeth 48 are aligned with corresponding grooves 50

(FIG. 4) in the weapon receiver 52. These slots are also symmetrical. This alignment allows the lock ring 44 and chamber 14 assembly to slide freely within the receiver 52 during movement between the in-battery and recoil positions.

Figure 4:
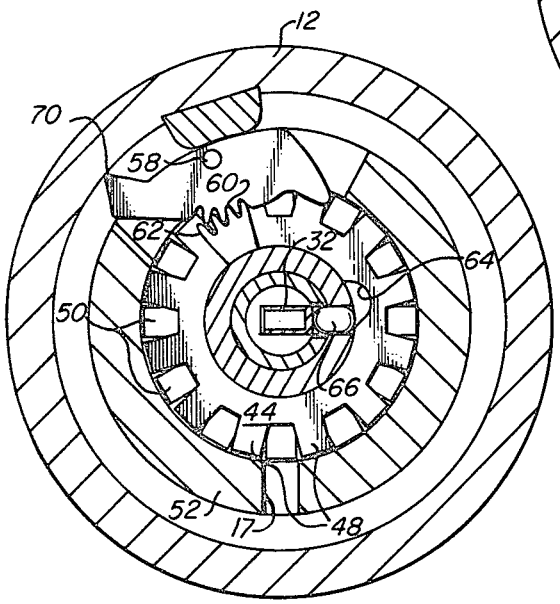
FIG. 4 is a view similar to FIG. 3 wherein the locking structure is in the locked position in order to retain the chamber in the locked position.

Before the weapon is fired, the chamber 14 must be locked in the in-battery position to absorb the impulse generated by the detonated cartridge. Locking occurs as the drum cam 12 continues to rotate (from its position in FIG. 3 to that shown in FIG. 4). A lump cam 54, on the inner diameter of the drum cam 12, contacts the actuator 56 causing it to pivot about pin 58 on receiver 52. The actuator 56 actuates lock ring 44 by means of mating gear teeth 60, 62. The pivotal movement of the actuator 56 causes rotational movement of the lock ring 44. The locking mechanism is then positioned as shown in FIG. 4 wherein the teeth 48 on the lock ring 44 are misaligned with the grooves 50 in the receiver. This prevents any rearward longitudinal movement of the chamber 14 to which lock ring 44 is rotatably attached. The weapon is now locked and ready for firing.

Firing occurs during the last few degrees of rotation of the lock ring 44. On the inside diameter of the lock ring 44 is a recessed cam path 64. Riding in the cam path 64 is the sear extension 66. As can be seen in FIG. 4, rotation of the lock ring 44 from its FIG. 3 position causes the sear extension 66 to be moved toward the sear 32. As the lock ring 44 reaches the full lock position, shown in FIG. 4, just enough lift has occurred to push the sear 32 from the sear notch 34 in bolt 26. The striker 30 is then driven forward by spring 68 and the round 38 is detonated (FIG. 1).

The actuator profile allows the weapon to remain locked while chamber pressure peaks and then diminishes. Continued rotation of the drum cam 12 causes the lump cam 54 to contact end 70 of the actuator 56. The actuator 56 pivots back to its original position, as shown in FIG. 3. The pivotal movement of the actuator 56 rotates the lock ring 44 back to its original position. The teeth 48 on the lock ring 44 are then realigned with the grooves 50 in the receiver 52. The chamber 14 is now freed for reciprocal movement within the receiver 52.

Figure 5:
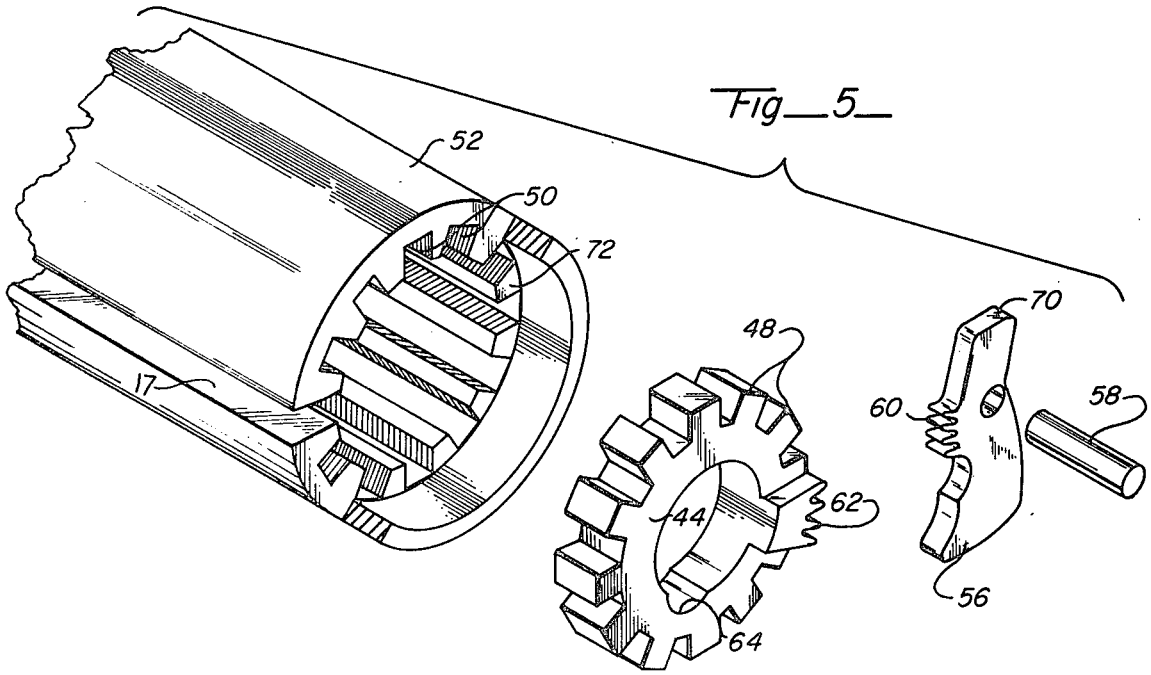
FIG. 5 is an exploded view of the parts in perspective showing their relationship and function.

FIG. 5 shows the components of the locking mechanism in perspective. This view should give a clearer indication of the shape of the parts and how they function. The receiver 52 is cut away to show its interior shape. It may be seen that lock ring 44 fits within receiver 52 and teeth 48 bear against the ends 72 of splines 74 when the ring 44 is in locked position, to prevent rearward movement of chamber 14 until after further rotation of the ring causes firing and subsequent further rotation to unlock chamber 14 and permit recoil.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A locking and firing mechanism for rotating-cam actuated weapons comprising:

a chamber longitudinally moveable between forward in-battery and rear recoil positions, said chamber having an actuating stud thereon, said weapon having a rotating drum with a helical cam path thereon engageable with said stud whereby rotation of said drum causes longitudinal movement of said chamber, locking means for locking said chamber in in-battery position including a locking ring rotatably mounted on said chamber, said weapon having a receiver with longitudinal grooves therein, said locking ring having teeth thereon engageable with said grooves when said locking ring is rotated in one direction to unlocked position and out of engagement therewith when said locking ring is rotated in the opposite direction to locked position, said locking and firing mechanism including actuator means operable by said rotating drum for rotating said locking ring at preselected angles of rotation of said drum.

2. A locking and firing mechanism for rotating-cam actuated weapons as in claim 1, said actuator means being pivotally mounted on said receiver and engageable with said locking ring, a lump cam on said drum engageable with said actuator means to cause said actuator means to pivot and thus rotate said locking ring.

3. A locking and firing mechanism for rotating-cam actuated weapons as in claim 2 wherein said actuator means and said locking ring have cooperating gear teeth.

4. A locking and firing mechanism for rotating-cam actuated weapons as in claim 1 wherein said firing mechanism includes a cam path on said locking ring, a striker longitudinally moveable within a bolt within said chamber, said striker being held in "ready-to-fire" position by a sear on said striker engageable with a sear notch on said bolt, and searing means actuated by said cam path upon rotation of said locking ring for releasing said sear from said sear notch to cause firing of said weapon after said chamber has been locked in in-battery position.

5. A locking and firing mechanism for rotating-cam actuated weapons as in claim 4 wherein said searing means includes a sear extension in said cam path when said locking ring is in unlocked position, said sear extension bearing against said sear to fire said weapon when said locking ring is rotated to locked position.

* * * * *